United States Patent [19]

Roda

[11] 4,033,241

[45] July 5, 1977

[54] APPARATUS FOR MANUFACTURING CARDBOARD TUBES

[75] Inventor: Emilio Roda, Viganello, Switzerland

[73] Assignee: Roda Macchine S.A., Noranco, Switzerland

[22] Filed: Mar. 17, 1975

[21] Appl. No.: 559,045

[30] Foreign Application Priority Data

Mar. 25, 1974 Switzerland ..... 4290/74

[52] U.S. Cl. ..... 93/39.1 R; 93/77 R

[51] Int. Cl.[2] ..... B31B 3/74

[58] Field of Search ..... 93/39.1 R, 39.1 P, 94 R, 93/94 PS, 77 R

[56] References Cited

UNITED STATES PATENTS

| | | | |
|---|---|---|---|
| 1,892,675 | 1/1933 | Lyon et al. | 93/39 R |
| 3,111,063 | 11/1963 | Membrino | 93/39.1 R |
| 3,416,412 | 12/1968 | Wilcox | 93/39.1 R |
| 3,745,891 | 7/1973 | Bodendoerfer | 93/39 R |

FOREIGN PATENTS OR APPLICATIONS

| | | | |
|---|---|---|---|
| 820,173 | 4/1902 | France | 93/39.1 P |

*Primary Examiner*—Leon Gilden

*Attorney, Agent, or Firm*—Young & Thompson

[57] ABSTRACT

A machine for the manufacture of tubes of cardboard or like sheet material that have a length substantially greater than their width, comprises a core about which the sheet is bent to the desired shape of the tube. Sheets are advanced one by one into registry with the core, and then are bent in concave molds that are hinged together and that swing one by one to bend first one half and then the other of the sheet about the core, after which the seam is sealed. An extractor for the tube is provided, in the form of rods that are slidably located in complementary grooves in the core and that have protruding wings which, when moving from retracted to extended position, contact diametrically opposite edge portions of the formed tube to strip the tube from the core.

2 Claims, 6 Drawing Figures

APPARATUS FOR MANUFACTURING CARDBOARD TUBES

The present invention relates to a machine for the manufacture of tubes of cardboard or other material, which may be pre-printed and/or decorated on the outer surface. The machine is capable of manufacturing tubes of different cross-sectional shapes, and the tubes may be tapered throughout part or all of their lengths. Suitable uses for such tubes are as packing boxes and bottle holders and so on.

Present machines of known type for the manufacture of tubes work generally either to wind up a sheet of thin paper to obtain the consistency of the cardboard or to wind a strip of cardboard helically, the resulting tube being cut to the correct measurement and the ends being finished by tucking in end edges.

With these known machines, it is not possible to pre-print and pre-decorate the surface of the tubes unless the tubes are formed by an operation which involves a considerable loss of time and an increase in the cost.

A machine also exists (see Italian Patent Application No. 32846 A/71, which permits of obtaining tubes from pre-decorated and/or pre-printed sheet, but this machine works on a principle completely different from that according to the present invention and the machine has an hourly production rate which is much lower than the machine according to the invention. The machine according to the invention is based on the use of a sheet of cardboard or the like, pre-cut and, if desired, pre-printed and/or pre-decorated.

The machine according to the present invention differs completely from the known machines and permits a much higher hourly production. In its preferred form, the machine can be adjusted to any of a large number of tube shapes and such tubes may be tapered or partially tapered if required.

According to the present invention there is provided a machine for the manufacture of tubes of cardboard or the like sheet material, comprising a core means reproducing the inner shape of the tube to be formed, advancing means for advancing a sheet to be formed along a generatrix of the said core means, guide means for ensuring the exact disposition of the sheet on the generatrix of the core means, holding means for holding the sheet against the generatrix of the core means, two shaping jaws each reproducing about half the outer profile of the tube, the jaws being mounted for rotation around an axis from an initial position to an operative position in which each jaw presses half of the sheet against the outer surface of the core means, the movements of the jaws being phased so as first to compress one half of the sheet against the core and successively the other half to cause superimposing of the free edges of the sheet to be joined together, a presser means arranged to act to press together the two said edges when overlapped to join same together, retractable thrust means for detaching tubes from the inner core upon return of the jaws to their initial positions, and support means for preventing the bending of the core during the pressing together of the overlapped edges by the presser means.

An embodiment of the present invention will now be described, by way of example, with reference to the accompanying diagrammatic drawings, wherein.

Figure 1:
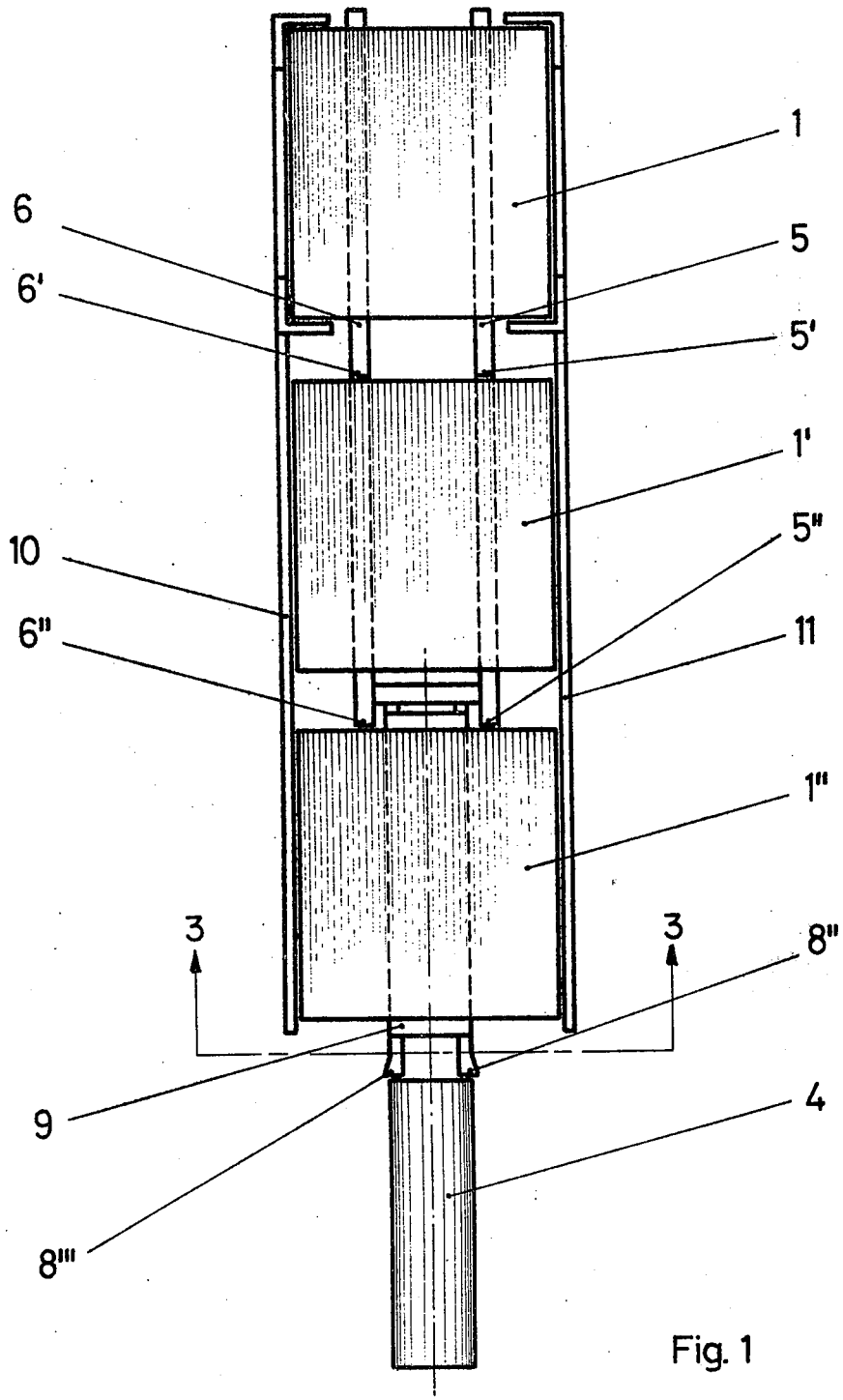
FIG. 1 shows in plan, the machine according to this embodiment.
Figure 2:
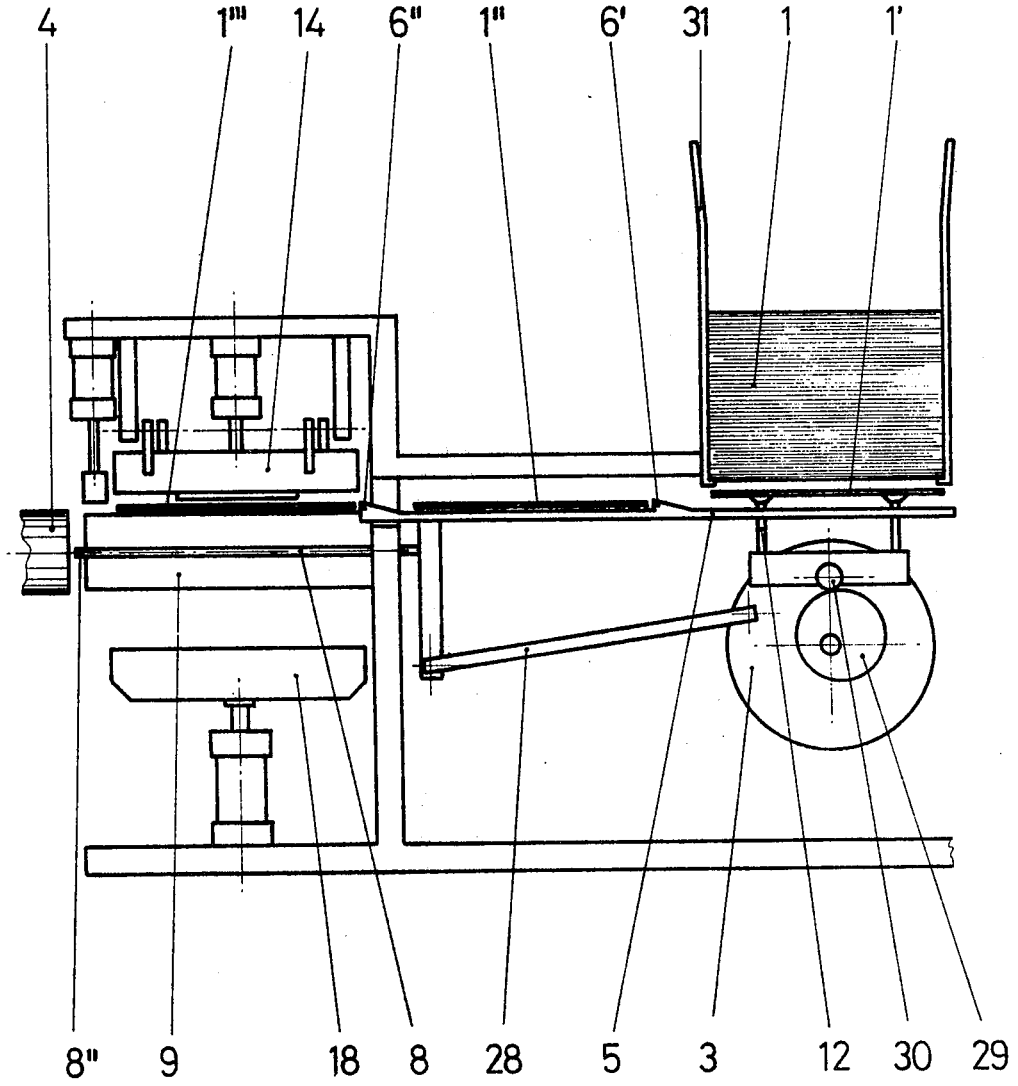
FIG. 2 is a side view of the machine shown in FIG. 1.
Figure 4:
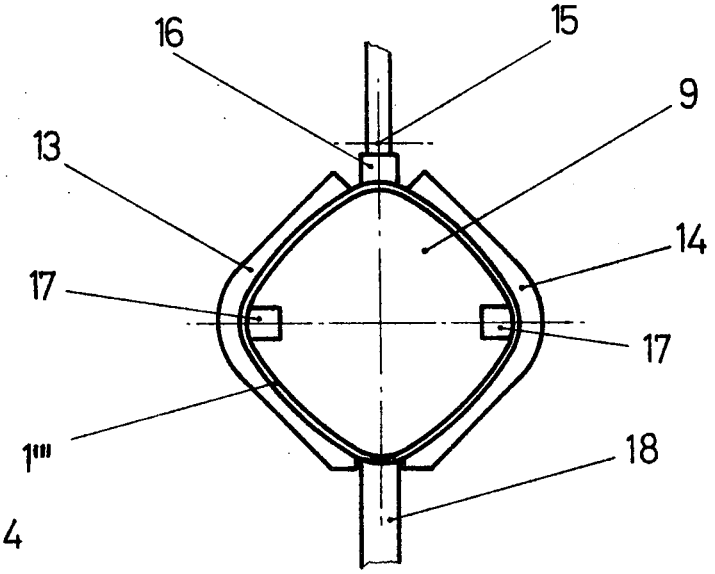
FIG. 4 is a view similar to FIG. 3, but showing the parts in a different operative position.
Figure 5:
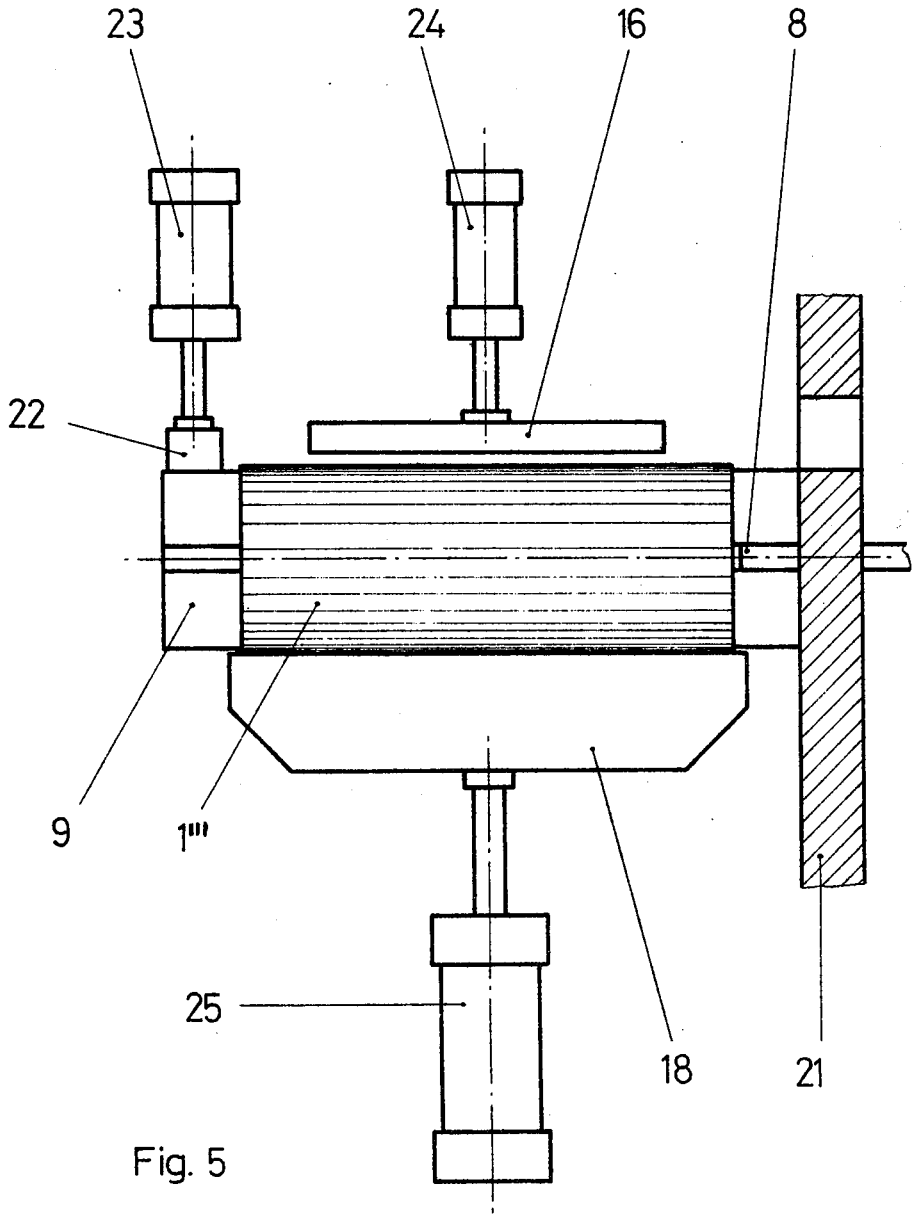
Figure 6:
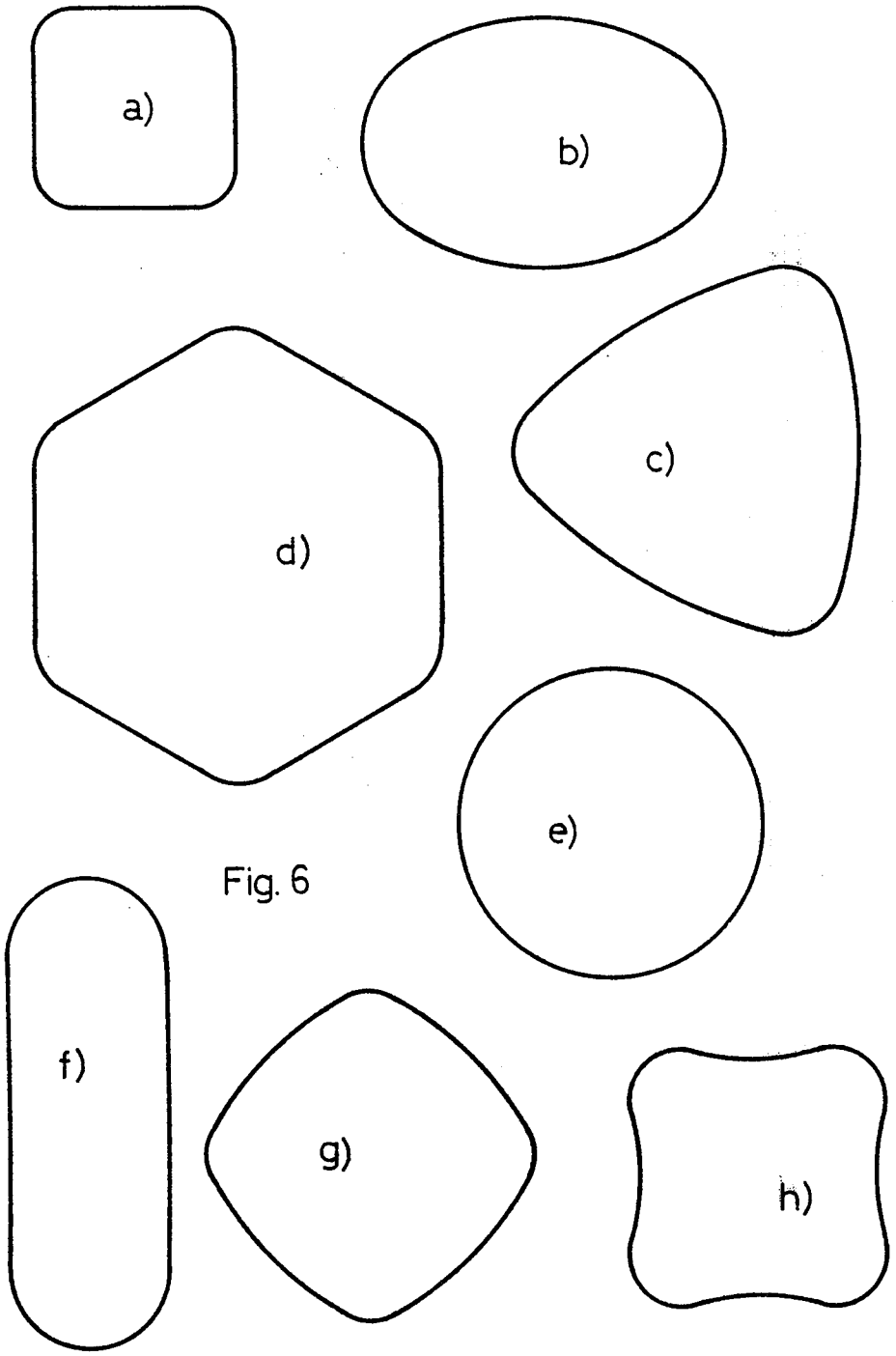

FIG. 5 is a sectional side view, and to enlarged scale of part of the machine shown in FIGS. 1 and 2, the machine being in the operational position shown in FIG. 4; and FIG. 6 shows a selection of possible cross-sectional shapes which tubes manufactured on the machine can have, the different cross-sectional shapes being indicated by references (*a*), (*b*), (*c*), (*d*), (*e*), (*f*), (*g*), (*h*) respectively.

Figure 3:
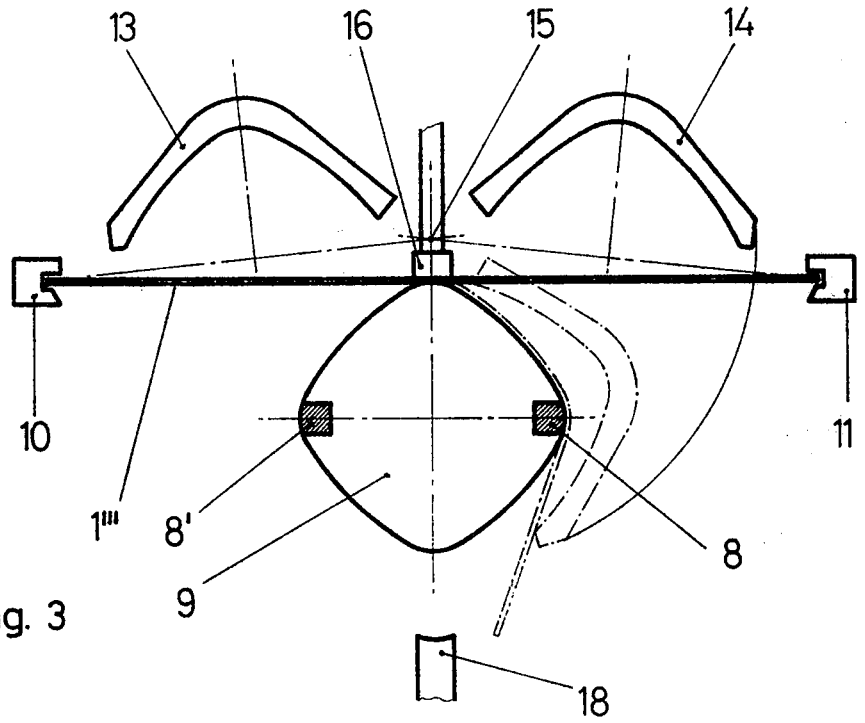
FIG. 3 is a sectional view taken on the line 3—3 of FIG. 1.

Referring to FIGS. 1,2,3 and 4, the machine comprises a shaping device for the tube which is constituted by an inner core 9 reproducing the inner shape of the tube to be formed, and two jaws 13,14 (FIG. 3) mounted so as to be able to rotate around the axis 15 to press a sheet 1''' of cardboard or the like as indicated in dot and dash lines in FIG. 3.

The jaws are moved in a phased manner in that the jaw 14 moves first and successively the jaw 13 moves to cause the two free edges of the sheet 1''' to become superimposed and subsequently to be pressed together by the presser 18 to effect the joining together of such edges. During this shaping operation, the pressure rod 16, actuated by the hydraulic cylinder and piston 24 (FIG. 5) holds the sheet of cardboard 1''' firmly pressing it against a generatrix of the core 9. Prior to shaping of the sheet 1''', the guides 10 and 11 keep the sheet 1'' perfectly in place in relation to the core 5.

The sheets are cut to size and are preferably of cardboard pre-printed and decorated. They may be such as to give rise to fully or partially tapered tubes, and the sheets may be provided with handle formation, holes or the like. These sheets are disposed in the vertical magazine 31, and are drawn off one-by-one from the bottom of the stack as indicated in relation to sheet 1' in FIG. 2, by means of a system of suction cups 12 which are raised and lowered as a result of interaction between the cam 29 when rotated and by the follower wheel 30.

Two rods 5 and 6 (see also FIG. 1) provided with thrust teeth 5', 5'', 6' and 6'', transport the sheets one by one from the position occupied by sheet 1' in FIG. 2 to the intermediate 1' in FIG. 2 and then to the end position occupied by sheet 1''' in FIG. 2 in which the sheet is formed into a tube by the shaping device 9, 13 and 14. During the transporting between these positions, if the edges of the sheet of cardboard which have to be stuck together are provided with a thermo soldering glue a preliminary heating of such edges can be provided by the guides 10 and 11 (FIG. 1) duly heated for this purpose.

During this transporting, it is also possible to deposit a coating of glue on the said edges if they are not preglued.

The advancing device formed by the two rods 5 and 6 is driven by the crank wheel 3 and rod 28 (FIG. 2) or by another and equivalent apparatus, as desired.

The control of the rotation of the two jaws 13 and 14 around the point 15 (FIG. 3) is effected by means of hydraulic or pneumatic devices or also simply mechanical devices of known type.

It is interesting to note that at the end of the core 9 (see FIG. 5) there is placed a support member 22 actuated by a hydraulic or pneumatic piston-cylinder 23. This support member prevents the bending the core 9 under the action of the presser 18 which can yield against spring action.

As already pointed out, the two jaws 13 and 14 apply the sheet of cardboard 1''' onto the core 9 whilst the presser 18 which is heated, presses the said edges until joining together is effected.

Heating means may be provided for heating the core 9 to facilitate the shaping and the joining together of the overlapping edges of the sheet.

In the core 9 there are diametrically opposite grooves 17 in which the rods 8, 8' respectively slide. The rods 8, 8' serve for the ejection of the finished tube from the core 9. These rods have at their ends wings 8'', 8''' and the rods can be drawn back inside the grooving 17 when the cardboard tube is formed. The rods with their wings 8'', 8''' then serve to thrust the formed tube forwards detaching it from the core 9.

It can be arranged that, upon being pushed off the core 9, the tube can meet and receive an end closure device which closes the end of the tube where it is to be used as a closed end tubular packaging container. The closure device may be presented to the tube by any suitable means of known type. The tubes which may be obtained with the machine in question can be varied in cross-section; for example, a tube of any of the cross-sections illustrated in FIG. 6 or any of many more possible completely different cross-sections as required, depending upon the market requirements, can be formed by using the appropriate core and jaws.

The tube may also be conical or truncated conical, pyramidal or truncated pyramidal, that is, of non constant section and provided also with openings or grips of any shape which will not interfere with the machine operation.

It is clear that the core 9 and the jaws 13 and 14 are such as to be easily interchangeable with others of different shape adapted to form tubes of different shape.

It is to be mentioned that parts of the machine described which are of known type may be replaced with others of known type without departing from the scope of the present invention.

We claim:

1. A machine for the manufacture of tubes of cardboard or the like sheet material that have a length substantially greater than their width, comprising a core means reproducing the inner shape of the tube to be formed, advancing means for advancing a sheet to be formed along a generatrix of said core means, guide means for ensuring the exact disposition of the sheet on the generatrix of the core means, holding means for holding the sheet against the generatrix of the core means, two shaping jaws each reproducing about half the outer profile of the tube, the jaws being mounted for rotation around an axis from an initial position to an operative position in which each jaw presses half of the sheet against the outer surface of the core means, the movements of the jaws being phased so as first to compress one half of the sheet against the core and successively the other half to cause superimposing of the free edges of the sheet to be joined together, a presser means arranged to act to press together the two said edges when overlapped to join same together, retractable thrust means for detaching tubes from the inner core upon return of the jaws to their mutual positions, and support means for preventing the bending of the core during the pressing together of the overlapped edges by the presser means, said retractable thrust means of the tube comprising rods slidably located within complementary grooves in the core means, said rods being provided with thrust wings which protrude from said grooves.

2. A machine according to claim 1 wherein said grooves and rods are disposed in diametrically opposite portions of the periphery of said core means that are spaced peripherally about said core means from said holding means and from said presser means.

* * * * *